US008043142B2

(12) United States Patent
Zeeb et al.

(10) Patent No.: US 8,043,142 B2
(45) Date of Patent: Oct. 25, 2011

(54) SHARPENER CARRIED BY THE PRODUCT TABLE OF A FOOD SLICER

(75) Inventors: Scott M. Zeeb, Chicago, IL (US); Scott J. Rote, New Lenox, IL (US); Aaron B. Eiger, Chicago, IL (US); Frank A. Bondarowicz, Glenview, IL (US)

(73) Assignee: Premark FEG L.L.C., Wilmington, DE (US)

( * ) Notice: Subject to any disclaimer, the term of this patent is extended or adjusted under 35 U.S.C. 154(b) by 904 days.

(21) Appl. No.: 11/348,892

(22) Filed: Feb. 7, 2006

(65) Prior Publication Data

US 2007/0049181 A1 Mar. 1, 2007

Related U.S. Application Data

(60) Provisional application No. 60/711,770, filed on Aug. 26, 2005.

(51) Int. Cl.
*B24B 7/00* (2006.01)
*B24B 19/00* (2006.01)

(52) U.S. Cl. ..... 451/192; 451/193; 451/196; 451/419; 451/422; 83/174

(58) Field of Classification Search ..... 451/194, 451/293, 349, 420, 70, 45, 196, 185, 192, 451/193, 198, 202, 203, 205, 206, 208, 224, 451/419, 422; 83/174, 174.1; 30/138, 139
See application file for complete search history.

(56) References Cited

U.S. PATENT DOCUMENTS

| | | | |
|---|---|---|---|
| 2,476 | A | 2/1842 | Morris |
| 19,982 | A | 4/1858 | Conroy |
| 28,179 | A | 5/1860 | Hunter |
| 1,424,875 | A | 8/1922 | Braun |
| 1,428,292 | A | 9/1922 | Lucey |
| 1,939,740 | A | 12/1933 | Van Berkel |
| 1,948,811 | A | 2/1934 | Van Berkel |

(Continued)

FOREIGN PATENT DOCUMENTS

| | | |
|---|---|---|
| BE | 494677 | 7/1950 |

(Continued)

OTHER PUBLICATIONS

International Search Report and Written Opinion issued regarding International Application No. PCT/US2006/032032 (Nov. 29, 2006).

(Continued)

*Primary Examiner* — Eileen P. Morgan
(74) *Attorney, Agent, or Firm* — Thompson Hine LLP

(57) ABSTRACT

A food slicer has a support member including a base portion and an upstanding portion integrally formed with the base portion. The upstanding portion includes a rotating cutting blade for slicing food product. The base portion includes a food product table slidably secured thereto for movement across the cutting blade for holding product while it is being sliced. An adjustable gage plate is provided for determining the thickness of a food product to be sliced. A sharpening mechanism for sharpening the cutting blade as needed is removably secured to a portion of the product table to provide accurate sharpening of the cutting blade. The sharpening mechanism includes a first rotating sharpening member and a second deburring member where the first and second members are mounted independent from each other.

10 Claims, 6 Drawing Sheets

U.S. PATENT DOCUMENTS

| | | | | |
|---|---|---|---|---|
| 1,977,418 | A | 10/1934 | Winkler | |
| 2,026,096 | A | 12/1935 | Muhlbauer | |
| 2,052,365 | A | 8/1936 | Stukart | |
| 2,052,367 | A | 8/1936 | Folk | |
| 2,486,797 | A | 11/1949 | Meyer | |
| 2,563,120 | A | 8/1951 | Klingens et al. | |
| 2,573,629 | A | 10/1951 | Klingens et al. | |
| 2,598,740 | A * | 6/1952 | Zimmermann | 83/717 |
| 2,614,373 | A | 10/1952 | Van Duyn et al. | |
| 2,619,142 | A * | 11/1952 | Ditting | 83/478 |
| 2,665,531 | A | 1/1954 | Sivertsen | |
| 2,728,176 | A | 12/1955 | Ritzert | |
| 3,051,207 | A | 8/1962 | Hartley | |
| 3,124,185 | A | 3/1964 | Karp | |
| 3,176,560 | A | 4/1965 | Bardenhagen | |
| 3,182,700 | A | 5/1965 | Engi | |
| 3,319,681 | A | 5/1967 | Anecki | |
| 3,320,990 | A | 5/1967 | Anecki | |
| 3,442,312 | A | 5/1969 | Karp | |
| 3,452,833 | A | 7/1969 | Wolters | |
| 3,583,452 | A | 6/1971 | Muller | |
| 3,613,754 | A | 10/1971 | Hartley | |
| 3,672,420 | A | 6/1972 | Hartley | |
| 3,677,316 | A | 7/1972 | Markham | |
| 3,706,736 | A | 12/1972 | Pratley | |
| 3,713,470 | A | 1/1973 | Muller | |
| 3,736,825 | A | 6/1973 | Covell | |
| 3,739,677 | A | 6/1973 | Muller | |
| 3,772,951 | A | 11/1973 | Repetto | |
| 3,782,230 | A | 1/1974 | Bettcher | |
| 3,857,310 | A | 12/1974 | Tiby | |
| 3,871,260 | A * | 3/1975 | Rees | 83/478 |
| 3,938,602 | A | 2/1976 | Sly et al. | |
| 3,958,475 | A | 5/1976 | Zapomel | |
| 3,958,478 | A | 5/1976 | Camper | |
| 3,965,783 | A | 6/1976 | Muller et al. | |
| 3,986,304 | A | 10/1976 | Shie | |
| 4,015,494 | A | 4/1977 | Spooner | |
| 4,186,634 | A | 2/1980 | Akczinski, Sr. | |
| 4,227,656 | A | 10/1980 | Engebretsen | |
| 4,246,818 | A | 1/1981 | McGraw, Jr. | |
| 4,266,456 | A | 5/1981 | Oostvogels | |
| D259,883 | S | 7/1981 | Engebretsen | |
| 4,306,385 | A | 12/1981 | Burton | |
| 4,386,483 | A | 6/1983 | Schlaefli | |
| 4,434,694 | A | 3/1984 | Scharsig | |
| 4,499,804 | A | 2/1985 | Takeda | |
| 4,528,777 | A | 7/1985 | Bernstein et al. | |
| 4,532,840 | A | 8/1985 | Antonissen | |
| 4,541,319 | A | 9/1985 | Maurer et al. | |
| 4,543,868 | A | 10/1985 | Maurer et al. | |
| 4,546,685 | A | 10/1985 | Maurer et al. | |
| 4,653,373 | A | 3/1987 | Gerber | |
| 4,685,364 | A * | 8/1987 | Scheflow et al. | 83/68 |
| 4,732,056 | A | 3/1988 | Foster | |
| 4,732,064 | A | 3/1988 | Pearl | |
| 4,793,228 | A | 12/1988 | Etter et al. | |
| 4,811,521 | A | 3/1989 | Nakae et al. | |
| 4,813,316 | A | 3/1989 | Johnson et al. | |
| 4,817,480 | A | 4/1989 | Young | |
| 4,829,721 | A | 5/1989 | Wright | |
| 4,962,581 | A | 10/1990 | Rutigliano | |
| 5,001,887 | A | 3/1991 | Eder et al. | |
| 5,038,647 | A | 8/1991 | Biagiotti | |
| 5,101,704 | A | 4/1992 | Jones et al. | |
| 5,152,105 | A | 10/1992 | Belvederi | |
| 5,188,011 | A | 2/1993 | Somal et al. | |
| 5,209,150 | A * | 5/1993 | Arconada Arconada | 83/174.1 |
| 5,224,407 | A | 7/1993 | Koch et al. | |
| 5,241,885 | A | 9/1993 | Kuchler | |
| 5,461,957 | A | 10/1995 | Koch et al. | |
| 5,509,337 | A | 4/1996 | Norman | |
| 5,591,072 | A * | 1/1997 | Tweed et al. | 451/293 |
| 5,609,512 | A * | 3/1997 | Holmes et al. | 451/48 |
| 5,615,591 | A | 4/1997 | Scherch et al. | |
| 5,649,463 | A | 7/1997 | Lindee et al. | |
| 5,666,866 | A | 9/1997 | Huang et al. | |
| 5,687,626 | A | 11/1997 | Scherch et al. | |
| 5,787,776 | A | 8/1998 | Nishimoto | |
| 5,941,148 | A | 8/1999 | Miller et al. | |
| 5,970,840 | A | 10/1999 | Yan et al. | |
| 6,016,734 | A | 1/2000 | Koch | |
| 6,092,448 | A | 7/2000 | Cartwright et al. | |
| 6,092,450 | A | 7/2000 | Dueck | |
| 6,167,791 | B1 | 1/2001 | Heckman et al. | |
| 6,209,438 | B1 | 4/2001 | Mitchell et al. | |
| 6,371,835 | B1 * | 4/2002 | Flisram et al. | 451/48 |
| D463,713 | S | 10/2002 | Zhu | |
| 6,709,319 | B2 * | 3/2004 | Yan | 451/70 |
| 2001/0018317 | A1 | 8/2001 | Yan | |
| 2001/0049987 | A1 | 12/2001 | Vivirito et al. | |
| 2006/0150791 | A1 * | 7/2006 | Chase et al. | 83/42 |

FOREIGN PATENT DOCUMENTS

| | | | |
|---|---|---|---|
| CN | 2306110 | Y | 2/1999 |
| DE | 1204965 | | 11/1965 |
| DE | 1432500 | | 11/1968 |
| DE | 29601840 | | 6/1997 |
| EP | 0115788 | A1 | 8/1984 |
| EP | 0202777 | A2 | 11/1986 |
| EP | 0248354 | A2 | 12/1987 |
| EP | 0724931 | A1 | 8/1996 |
| EP | 0776265 | A1 | 6/1997 |
| EP | 0827816 | A1 | 3/1998 |
| EP | 0 881 045 | A2 | 12/1998 |
| EP | 0972619 | A2 | 1/2000 |
| GB | 1560874 | | 2/1978 |
| GB | 2021452 | A | 12/1979 |
| GB | 2061780 | A | 5/1981 |
| WO | WO 94/11279 | | 5/1994 |
| WO | WO 95/32846 | | 12/1995 |
| WO | WO 95/33601 | | 12/1995 |
| WO | WO 96/05952 | | 2/1996 |
| WO | WO 98/55277 | | 12/1998 |
| WO | WO 00/40367 | | 7/2000 |
| WO | WO 00/66333 | | 11/2000 |

OTHER PUBLICATIONS

International Preliminary Report on Patentability issued regarding International Application No. PCT/US2006/032032 (Feb. 26, 2008).

Instruction Manual . . . with Catalog of Replacement Parts; Hobart-Model 1612 Meat Slicer; The Hobart Manufacturing Company, Troy, Ohio, Dec. 1963; 12 pages.

Automatic Precision Slicer SE 12 D; Bizerba, 9 pages.

* cited by examiner

SHARPENER CARRIED BY THE PRODUCT TABLE OF A FOOD SLICER

CROSS-REFERENCE TO RELATED APPLICATIONS

This application claims benefit of U.S. provisional patent application Ser. No. 60/711,770, filed Aug. 26, 2005, which is herein incorporated by reference.

TECHNICAL FIELD

The present invention relates generally to food slicers and more particularly to a new design for sharpener for the food slicer blade that provides for an enhanced sanitary environment, enables easier operation and cleaning and incorporates a number of enhanced ergonomic features.

BACKGROUND

The basic design of both manual and automatic food slicers has proven to be quite effective and durable throughout the years. Although various important improvements have been made to such slicers, the overall design has not changed very much particularly with regard to the overall cleanliness, ergonomics, or ease of operation.

Today, food slicers are utilized to slice a number of food products such as meats, cheeses and the like in a variety of environments such as delicatessens, supermarkets, and restaurants to name a few. Such food slicers need to be quite durable since they tend to be used for many hours during a day by many different individuals while providing the desired performance, safety and cleanliness.

Additionally, food slicers need to be designed to allow adaptability since they need to handle a variety of products of different shapes, sizes, and textures while readily providing slices of different thicknesses of the product being sliced. The speed at which a particular product is moved across the cutting blade can also vary on automatic food slicers to improve productivity.

To ensure a sharp blade for accurate slicing; food slicers typically include some type of sharpening mechanism. Such mechanisms usually are either mounted to the food slicer during use and only removed for cleaning or are only mounted to the slicer for sharpening and stored elsewhere when not sharpening the blade.

With the first type of mechanism, contamination from food scraps and juices can be a concern for the sharpener itself as well as any mounting mechanisms or additional guarding used to provide for enhanced safety. With the second type of mechanism, care must be exercised since the sharpener needs to be accurately mounted by an operator close to the blade with the gage plate in its fully open position.

SUMMARY

In accordance with an embodiment, a food slicer is provided having a support member including a base portion and an upstanding portion integrally formed with the base portion. The upstanding portion includes a rotating cutting blade secured thereto for slicing food product and at least one motor positioned within the upstanding portion for rotating the cutting blade.

The base portion includes a food product table slidably secured thereto and is movable across the cutting blade for holding product while it is being sliced by the cutting blade.

An adjustable gage plate also is provided for determining the thickness of a food product to be sliced by the cutting blade.

A sharpening mechanism for the cutting blade is provided for sharpening the blade as needed, the sharpening mechanism being removably secured to a portion of the product table to provide accurate sharpening of the blade. The sharpening mechanism including a first rotating sharpening member and a second deburring member where the first and second members are mounted independent from each other.

BRIEF DESCRIPTION OF THE DRAWINGS

The present disclosure will become better understood with reference to the following description and accompanying drawings, wherein.

DETAILED DESCRIPTION

Figure 1:
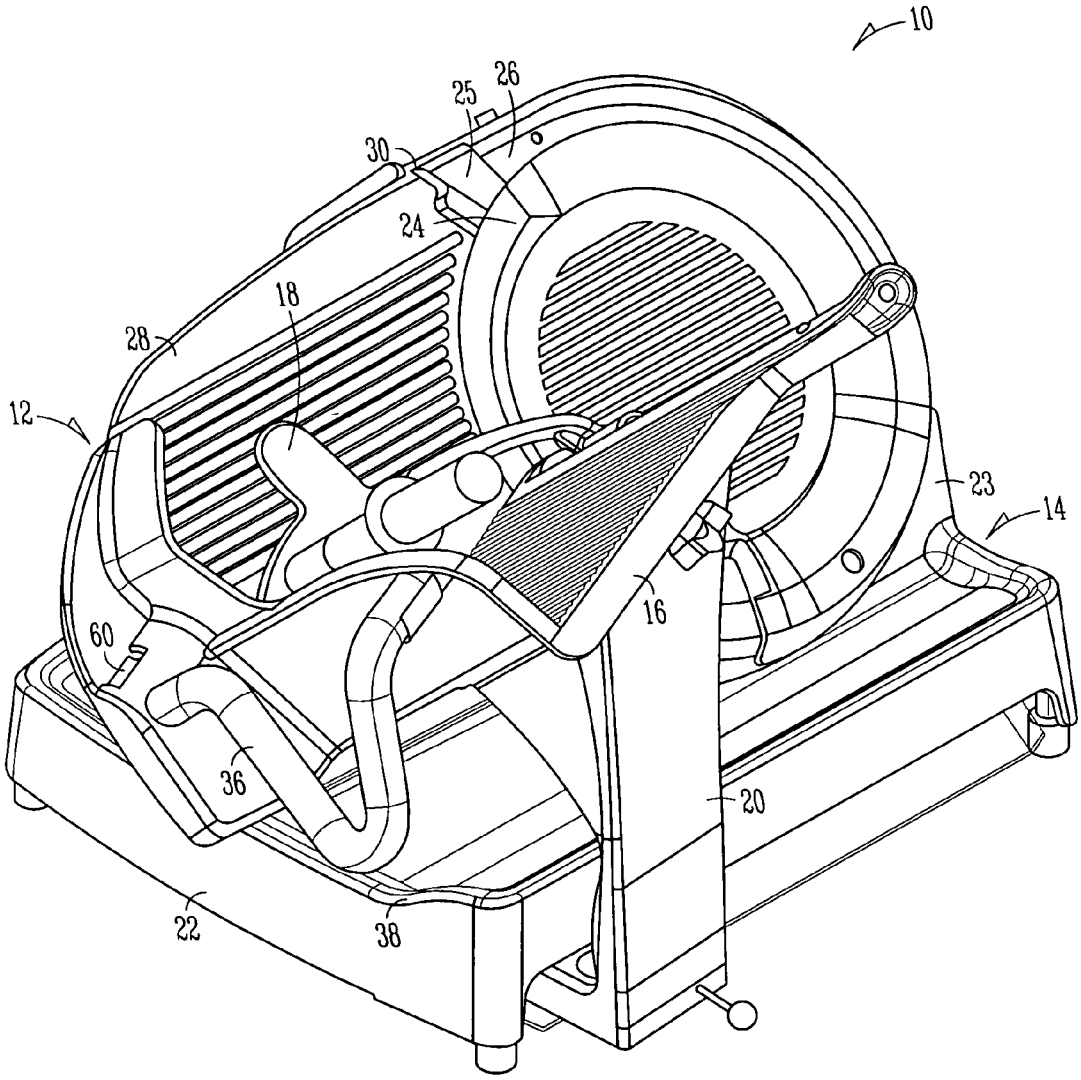
FIG. 1 is a top right perspective view of a food slicer according to one embodiment of the present invention.
Figure 2:
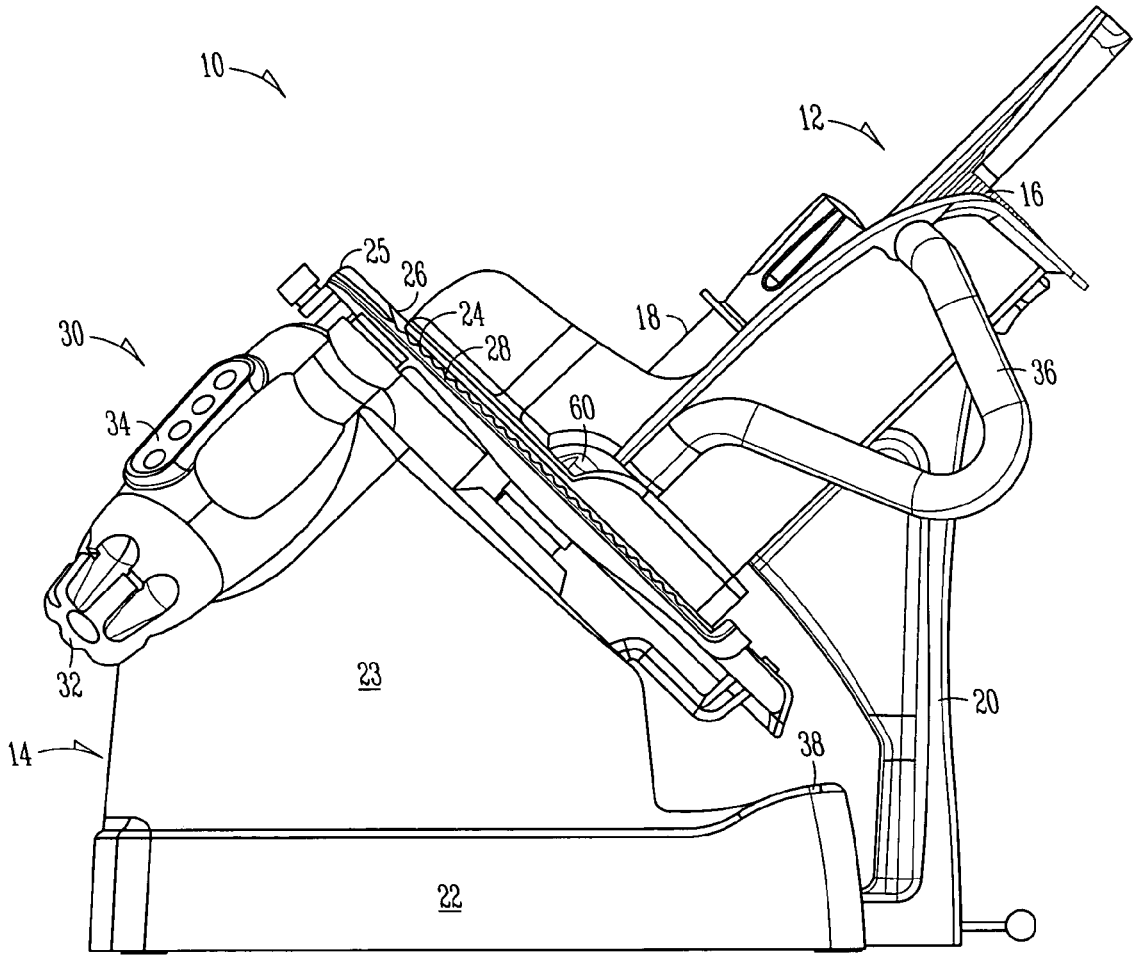
FIG. 2 is a front plan view of the food slicer of FIG. 1.

The food slicer of the present invention is generally illustrated by numeral 10 of FIGS. 1-2 wherein like parts are designated by like reference numerals. Although the present disclosure will be described with reference to the example embodiments illustrated in the figures, it should be understood that the food slicer 10 may have many alternative forms without departing from the teachings of the present invention. One of ordinary skill in the art will additionally appreciate different ways to alter the parameters of the embodiments disclosed, such as the size, shape, or type of elements or materials, in a manner that falls within the spirit and scope of the present disclosure and appended claims.

FIGS. 1 and 2 illustrate the basic components of the food slicer 10 of the present invention. The food slicer 10 substantially includes a food handling portion generally illustrated by reference numeral 12 and a support portion, housing or member generally illustrated by reference numeral 14.

The food handling portion 12 substantially includes a product table 16, a push arm or pusher 18 and a product table support arm 20. The support portion 14 substantially includes a base portion or member 22, an upstanding portion or member 23, a rotating circular slicing knife or cutting blade 24, a ring guard 25, a knife cover 26, an adjustable gage plate 28 for determining slicing thickness and a control member or operator interface 30 having a gage plate support and adjustment mechanism 32 for the gage plate 28 and control buttons 34 as illustrated in FIG. 2.

The support portion 14 also includes at least one motor (not illustrated) positioned within the inside of the upstanding portion 23. If desired, a second motor (not illustrated) may be positioned within the inside of the support portion 14 along with associated structure for automatically moving the product table 16.

Briefly, for manual slicing, a food product (not illustrated) is placed on the product table 16 beneath the pusher 18 with the end to be cut or sliced resting upon the gage plate 28 with the product table 16 in its forward position. The operator adjusts the gage plate adjustment mechanism 32 which directly moves the gage plate 28 with respect to the blade 24 to provide a slice thickness gap therebetween that corresponds to the desired thickness for slicing of the product and gets bigger with thicker slices. The control buttons 34 are then accessed to turn the motor on which in turn rotates the blade 24.

The operator then pushes the product table 16 preferably via a handle 36 or other contact point forward or to the right with respect to FIG. 1 whereby the blade 24 slices the product to the desired thickness. The operator then pulls the product table 16 backward or to the left with respect to FIG. 1 for continued slicing of the product as described above.

Figure 4:
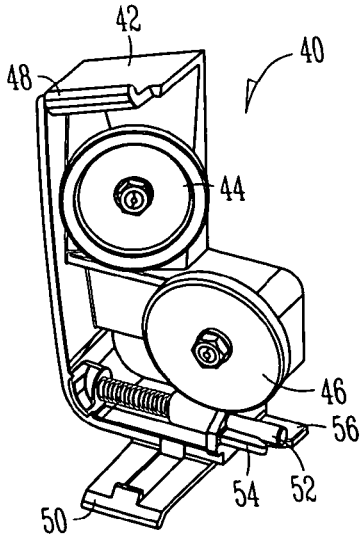
FIG. 4 is a perspective view of the sharpening mechanism for use with the product table and food slicer of FIGS. 1-3.
Figure 5:
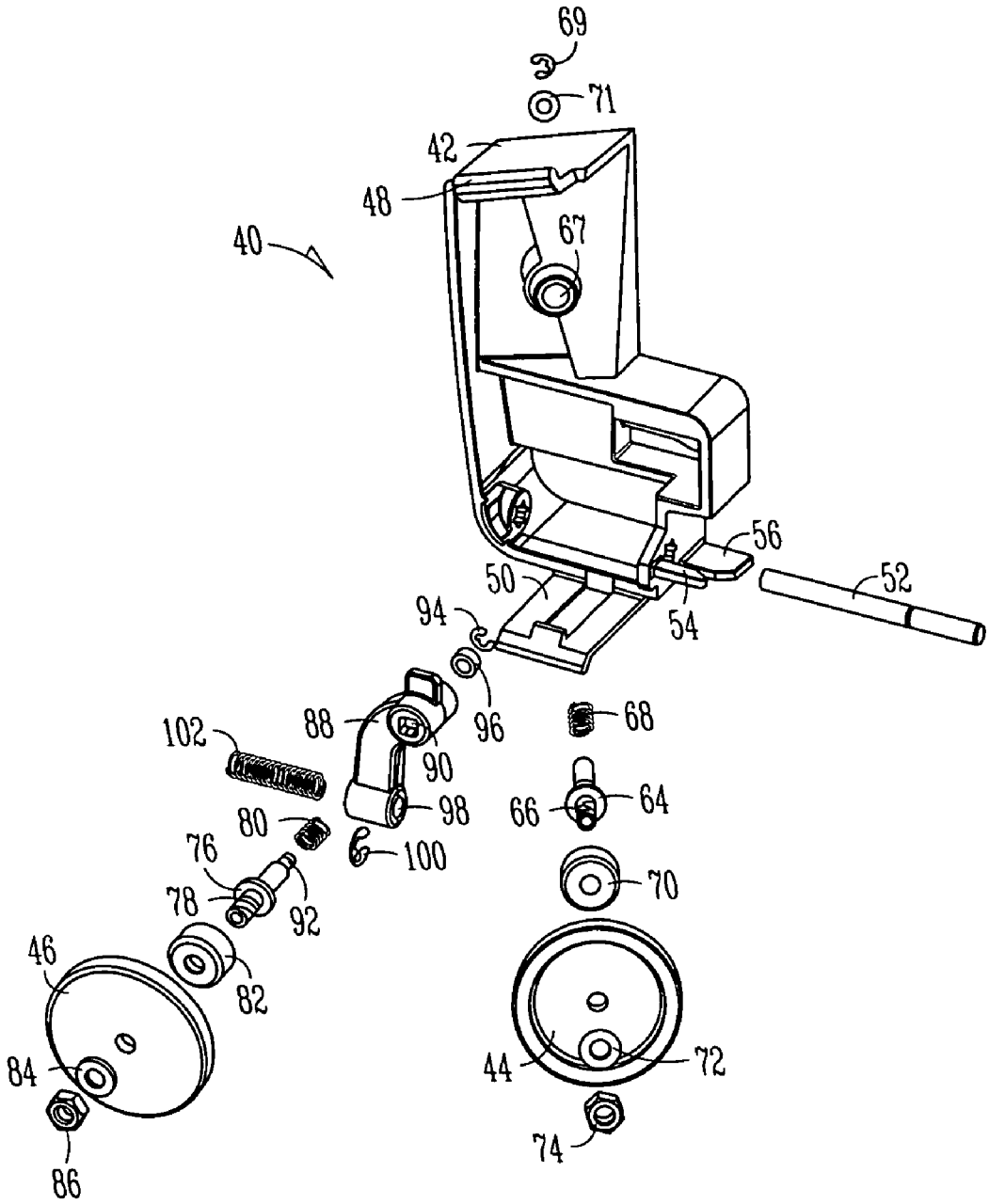
FIG. 5 is an exploded perspective view of the sharpening mechanism of FIG. 4.

FIGS. 4 and 5 generally illustrate a sharpening mechanism 40 for use with the food slicer 10. The sharpening mechanism 40 substantially includes a housing 42, sharpening member or stone 44, deburring member or stone 46, retaining tab 48, spring clip 50, plunger 52 and two alignment members 54 and 56. It is to be noted that the design, size, shape and material of either the sharpening stone 44 or deburring stone 46 can vary.

Figure 3:
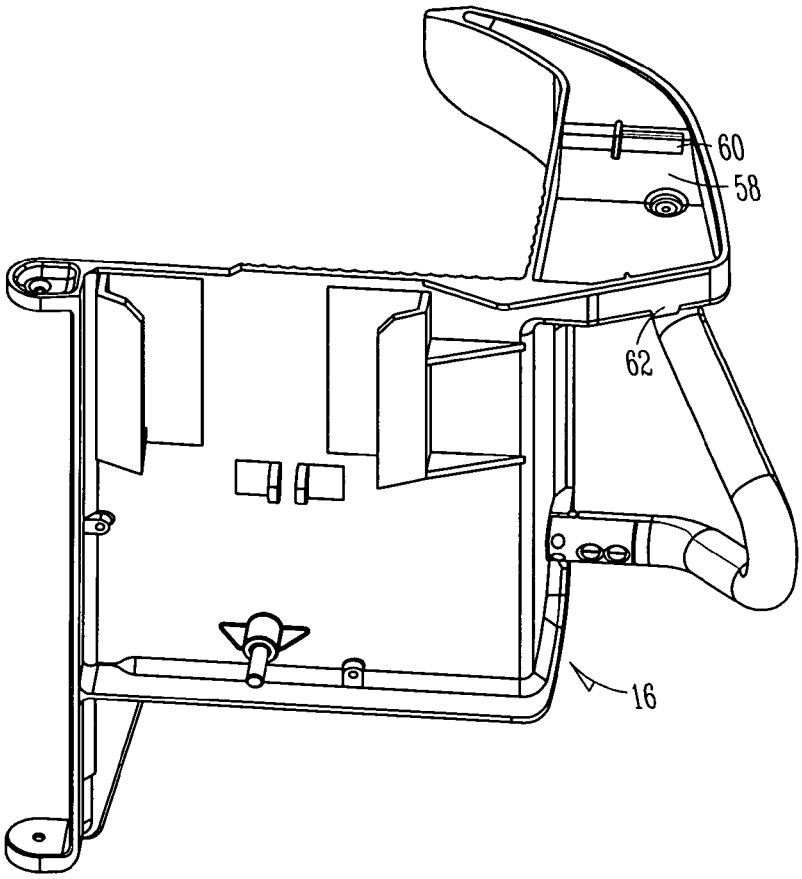
FIG. 3 is bottom perspective view of the food product table of the food slicer of FIGS. 1 and 2.

Briefly, with reference to FIGS. 3 and 4, the sharpening mechanism 40 is removably secured within a pocket 58 formed on the bottom portion of the food product table 16 that generally faces the blade 24 (not illustrated). To attach the sharpening mechanism 40 within the pocket 58, the retaining tab 48 is seated within a slotted aperture 60 (see FIGS. 1-3) and the spring clip 50 engages with a tab 62 on the product table 16.

Once attached, the product table 16 with the sharpening mechanism 40 secured thereto can be moved back and forth as it does when slicing provided the gage plate 28 (FIGS. 1 and 2) is in its fully open position. To remove the sharpening mechanism 40 from the product table 16, the spring clip 50 is disengaged from the tab 62, the sharpening mechanism 40 is pivoted about the retaining tab 48, and the retaining tab 48 is removed from the slotted aperture 60.

It is to be noted that the sharpening mechanism 40 can only be secured to and removed from the product table 16 when the product table 16 is moved to its fully forward position with respect to the slicer 10. When viewed from what typically is referred to as the right side of the slicer 10 as illustrated in FIG. 1, the fully forward position of the product table 16 would be to the far left. The gage plate 28 is preferably closed, but can be opened if desired. Likewise, the blade 24 may or may not be running or rotating at this time.

Figure 6:
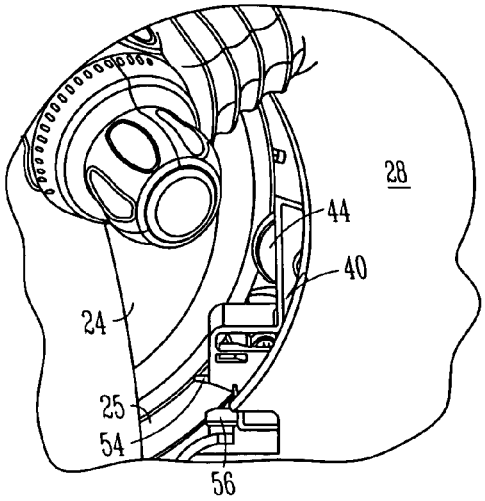
FIG. 6 is an enlarged perspective view of a portion of the food slicer of FIGS. 1 and 2 illustrating the alignment members of the sharpening mechanism.
Figure 7:
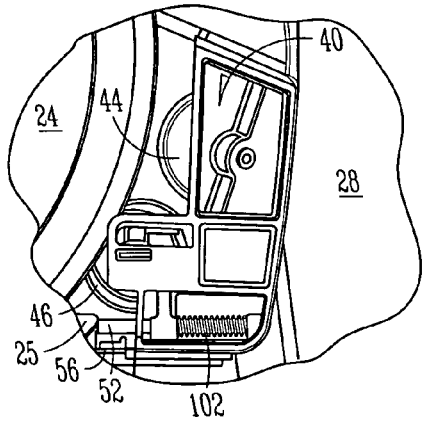
FIG. 7 is an enlarged perspective view of a portion of the food slicer of FIGS. 1 and 2 illustrating the sharpening mechanism in an initial engagement position with respect to the blade of the food slicer.
Figure 8:
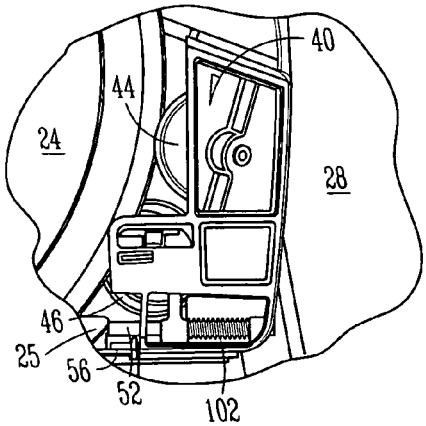
FIG. 8 is an enlarged perspective view, similar to FIG. 7, illustrating the sharpening mechanism in an intermediate engagement position with respect to the blade of the food slicer.
Figure 9:
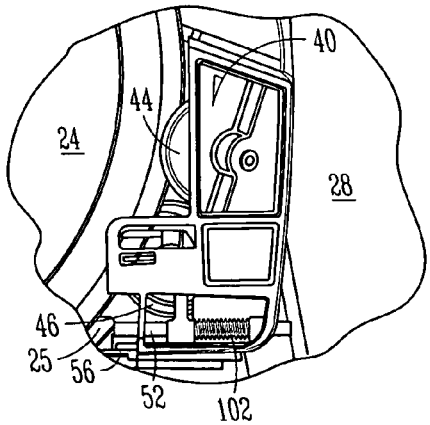
FIG. 9 is an enlarged perspective view, similar to FIGS. 7 and 8, illustrating the sharpening mechanism in a fully engaged position with respect to the blade of the food slicer.

When secured to the product table 16, the sharpening mechanism 40 can be moved into engagement with the blade 24 merely by moving the product table 16 toward the blade 24 or toward the rear of the slicer 10, which would be to the right when the slicer 10 is viewed from its right side as illustrated in FIG. 1. As FIG. 6 illustrates, the alignment members 54 and 56 engage with respective portions of the ring guard 25 to ensure proper alignment of the sharpening stone 44 with the blade 24 and assist in stabilizing the sharpening member 40 during sharpening. In one preferred embodiment, the alignment members or tabs 54 and 56 straddle a portion of the ring guard 25 (see FIGS. 7-9 showing tab 56 only) whereby an inner surface of each tab 54 and 56 engages with an outer surface of the ring guard 25. It is to be noted that this alignment is provided automatically upon engagement of the sharpening mechanism 40 with the ring guard 25 with no further adjustment by an operator and ensures proper position of both the sharpening stone 44 and deburring stone 46 with respect to the blade 24.

As FIG. 5 illustrates, both the sharpening stone 44 and deburring stone 46 are preferably designed to be mounted independently from each other to the sharpening mechanism 40 for rotational movement as well as movement in a spring loaded manner in a direction substantially along their central axis to apply the appropriate force to the blade 24 as desired with no additional actions from an operator. Thus, the mechanism for mounting the sharpening stone 44 includes a shaft 64 with a threaded end 66, spring 68, skirt 70, washer 72 and nut 74 for threaded engagement with the threaded end 66 of the shaft 64. The opposite end of the shaft 64 is inserted within an aperture 67 of the housing 42 and secured with a clip 69 and a washer 71. Of course, if desired, the sharpening stone 44 or deburring stone 46 can be of any other shape and may not rotate or move along its axis.

Similarly, the mechanism for mounting the deburring stone 46 includes a shaft 76 with threaded end 78, spring 80, skirt 82, washer 84 and nut 86. Additional members for mounting the deburring stone 46 for movement by the plunger 52 include a frame 88 having an aperture 90 through which an end 92 of the shaft 76 is inserted and secured to the frame 88 with a clip 94 and a busing 96 therebetween. A cammed surface 97 (FIGS. 10 and 11) also is included on the housing 42 for axial movement of the deburring stone 46 as described below.

The frame 88 includes a second aperture 98 through which the plunger 52 is inserted and secured with a clip 100 and secures the deburring stone 46 and associated hardware to the housing 42. To spring load the plunger 52, a spring 102 also is included. With this design, the deburring stone 46 also is capable of movement in a direction substantially parallel to the length of the plunger 52 when the plunger engages with the ring guard 25 to enable the sharpening stone 44 to engage the blade 24 as described below.

Sharpening of the blade 24 will now be described with reference to FIGS. 6-9. As FIGS. 6 and 7 illustrate, upon moving the product table 16 with the sharpening mechanism 40 secured thereto toward the blade 24 with the gage plate 28 in its fully opened position, the alignment members 54 and 56 engage the ring guard 25 to properly align the sharpening mechanism 40. The plunger 52 also engages the ring guard 25 at this point and the end 92 of the shaft 76 of the deburring stone 46 is positioned against a first portion 104 of the cammed surface 97 as illustrated in FIG. 10.

As FIG. 8 illustrates, upon continued movement of the product table 16 toward the blade 24 the plunger 52 compresses the spring 102 and moves the deburring stone 46 into engagement with the front side of the blade 24 facing the product table 16. As FIG. 9 illustrates, continued movement of the product table 16 toward the blade 24 further compresses the spring 102 thereby moving the deburring stone 46 in a direction parallel to the length of the plunger 52 to bring the sharpening stone 44 into engagement with the back side of the blade 24 opposite the product table 16.

Figure 10:
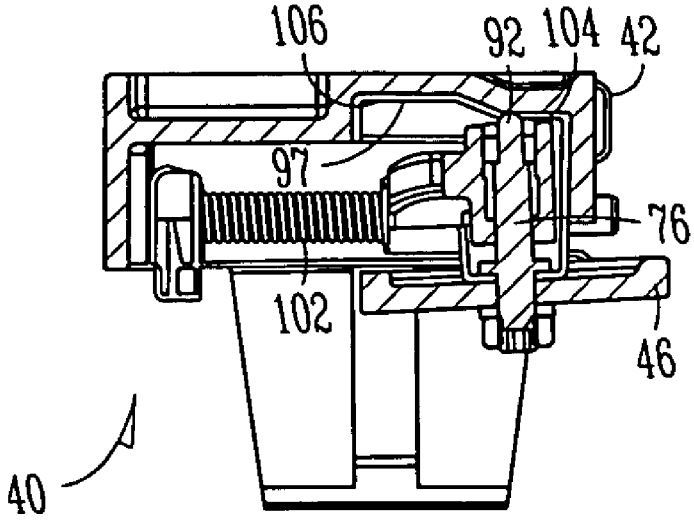
FIG. 10 is an enlarged cross-sectional view of the sharpening mechanism taken downward through the deburring stone with the sharpening mechanism in an initial engagement position with respect to the blade or the food slicer.
Figure 11:
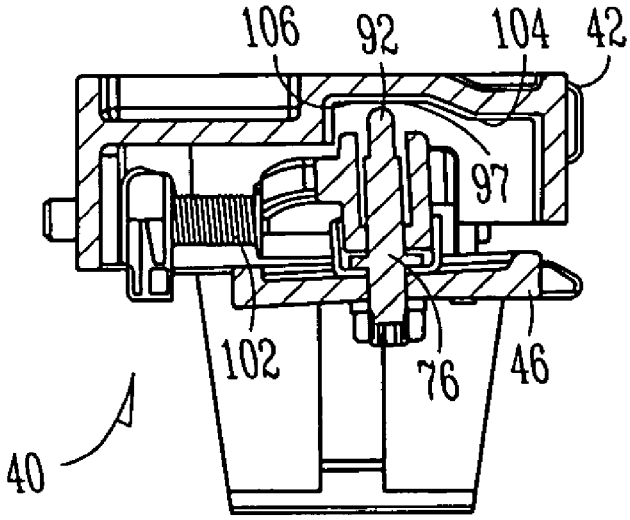
FIG. 11 is an enlarged cross-sectional view, similar to FIG. 10, illustrating the sharpening mechanism in a fully engaged position with respect to the blade of the food slicer.

At the same time, as FIGS. 10 and 11 illustrate, the deburring stone 46 moves parallel to the length of the plunger 52. The deburring stone 46 also moves along the axis of its shaft 76 against the load of the spring 80 by engagement of the end 92 of the shaft 76 with the cammed surface 97 of the housing 42. In the initial position of FIG. 10 the end 92 of the shaft 76 rests against the first portion 104 of the cammed surface 97. As FIG. 11 illustrates, as the deburring stone 46 moves to the left via the plunger 50 the end 92, spring loaded by the spring 80, moves into a second part 106 of the cammed surface 97 thereby moving the deburring stone 46 toward the housing 42 and blade 24 or upward with respect to FIG. 11. This axial movement of the deburring stone 46 enables proper positioning on the blade 24.

It is to be noted that the operator regulates the force of the blade 24 against the spring loads of the sharpening stone 44 and the plunger 50 by hand via movement of the product table 16. The deburring stone 46 is spring loaded against the blade 24 by its spring 80 as the end 92 of is shaft 76 travels from the first cam portion 104 into the second cam portion 106. Since the sharpening stone 44 is at an angle with respect to the blade 24, the spring 68 of the sharpening stone 44 and the force or pressure provided by the operator tend to control contact of the sharpening stone 44 with the blade 24. The operator should maintain this position for a few seconds to fully sharpen the blade 24 but not over sharpen or grind down the blade 24 more than is necessary Preferably, the blade 24 is running or rotating as the sharpening mechanism 40 is engaged with the blade 24. Sharpening and deburring of the blade 24 can occur concurrently provided the operator provides enough pressure on the spring 68 of the sharpening stone 44 through the product table 16. When the product table 16 is pulled away from the blade 24 to a position similar to FIG. 8, the sharpening stone 44 first disengages from the blade 24. The end 92 of the shaft 76 of the deburring stone 46, however, is still within the second cam portion 106 which keeps the deburring stone 46 in contact with the blade 24 for a short time to knock off any remaining burrs. Further movement of the product table 16 to the position similar to FIGS. 7 and 10 enables the end 92 of the shaft 76 of the deburring stone 46 to move to the first cam portion 104 thereby disengaging the deburring stone 46 from the blade 24.

After sharpening and deburring, the product table 16 can be moved back to the fully forward position and the sharpening mechanism 40 can be removed as described above for cleaning, soaking and sanitizing and then stored for future use. This design not only assists in reducing contamination of the slicer 10 during use, but does not require the hands of the operator to get near the sharp blade 24 during sharpening let alone set up and removal of the sharpening mechanism 40.

Numerous modifications and alternative embodiments of the present disclosure will be apparent to those skilled in the art in view of the foregoing description. Accordingly, this description is to be construed as illustrative only and is for the purpose of teaching those skilled in the art the best mode for carrying out the present disclosure. Details of the structure may vary substantially without departing from the spirit of the present disclosure, and exclusive use of all modifications that come within the scope of the appended claims is reserved. It is intended that the present disclosure be limited only to the extent required by the appended claims and the applicable rules of law.

What is claimed is:

1. A food slicer, comprising:

a support member having a base portion and an upstanding portion integrally formed with said base portion;

a rotating cutting blade secured to said upstanding portion for slicing food product;

at least one motor positioned within said upstanding portion for rotating said cutting blade;

a food product table slidably secured to said base portion and movable back and forth across said cutting blade for holding product while being sliced by said cutting blade;

an adjustable gage plate for determining the thickness of a food product to be sliced by said cutting blade; and a sharpening mechanism for sharpening said cutting blade as needed, said sharpening mechanism being removably secured to the food product table for movement with the food product table to engage said cutting blade and to provide sharpening of the cutting blade, the sharpening mechanism including a rotating sharpening member and a deburring member, said sharpening member and said deburring member being mounted independent from each other;

wherein the sharpening mechanism is removably secured within a pocket formed on a bottom portion of the food product table;

wherein said sharpening mechanism includes (i) a retaining tab that seats within a slotted aperture of the food product table and (ii) a spring clip that engages with a separate tab on the food product table.

2. The food slicer as defined in claim 1, wherein said deburring member is mounted to said sharpening mechanism for translational movement actuated by said food product table.

3. The food slicer as defined in claim 1, wherein said sharpening mechanism includes at least one alignment tab for ensuring accurate alignment with said cutting blade.

4. The food slicer as defined in claim 1, wherein at least one of said sharpening member and said deburring member is spring mounted to said sharpening mechanism for movement with respect to said sharpening mechanism to ensure proper engagement with said cutting blade.

5. A food slicer, comprising:

a support member having a base portion and an upstanding portion;

a rotating cutting blade secured to said upstanding portion for slicing food product;

at least one motor positioned for rotating said cutting blade;

a food product table slidably secured to said base portion and movable back and forth across said cutting blade for holding food product while being sliced by said cutting blade;

an adjustable gage plate for determining thickness of a food product to be sliced by said cutting blade;

said food product table including a sharpener receiving pocket formed in a cutting blade facing portion of said food product table;

a sharpening mechanism for sharpening said cutting blade, said sharpening mechanism including a sharpening member and a deburring member, said sharpening mechanism removably secured within said sharpener receiving pocket of said food product table for movement with said food product table such that said sharpening member and said deburring member are engaged with said cutting blade by moving said food product table from a forward position toward said cutting blade;

wherein said sharpening mechanism includes a spring clip that engages with a tab on said food product table for releasably securing said sharpening mechanism in said sharpener receiving pocket.

6. The food slicer as defined in claim 5 wherein said sharpening mechanism includes a retaining tab that seats within a slotted aperture of said food product table.

7. The food slicer as defined in claim 5, further comprising:

a ring guard mounted on the support member;

said sharpening mechanism includes at least one alignment tab that engages with a portion of said ring guard for alignment of said sharpening mechanism with said cutting blade during sharpening.

8. The food slicer of claim 5:

wherein said at least one alignment tab comprises a first alignment tab and a second alignment tab, said first and second alignment tabs straddle said portion of the ring guard during sharpening.

9. A food slicer, comprising:

a support member having a base portion and an upstanding portion;

a rotating cutting blade secured to said upstanding portion for slicing food product;

at least one motor positioned for rotating said cutting blade;

a food product table slidably secured to said base portion and movable back and forth across said cutting blade for holding food product while being sliced by said cutting blade said food product table including a sharpener receiving pocket formed in a cutting blade facing portion of said food product table;

an adjustable gage plate for determining thickness of a food product to be sliced by said cutting blade;

a sharpening mechanism for sharpening said cutting blade, said sharpening mechanism including a sharpening member and a deburring member, said sharpening mechanism removably secured within said sharpener receiving pocket of the cutting blade facing portion of said food product table for movement with said food product table such that said sharpening member and said deburring member are engaged with said cutting blade by moving said food product table from a forward position toward said cutting blade;

wherein said sharpening mechanism includes at least one of (i) a retaining tab that seats within a slotted aperture of said food product table or (ii) a spring clip that engages with a tab on said food product table for releasably securing said sharpening mechanism within said sharpener receiving pocket of the within said sharpener receiving pocket.

10. The food slicer of claim 9 wherein said sharpening mechanism includes both (i) the retaining tab that seats within the slotted aperture of said food product table and (ii) the spring clip that engages with the tab on said food product table for releasably securing said sharpening mechanism.

* * * * *